US011046561B2

(12) United States Patent
Zhu et al.

(10) Patent No.: US 11,046,561 B2
(45) Date of Patent: Jun. 29, 2021

(54) TENSION BALANCE SYSTEM AND METHOD FOR STEEL WIRE ROPES ON FRICTION HOISTING DRIVING END OF ULTRA-DEEP WELL

(71) Applicant: CHINA UNIVERSITY OF MINING AND TECHNOLOGY, Jiangsu (CN)

(72) Inventors: Zhencai Zhu, Jiangsu (CN); Guohua Cao, Jiangsu (CN); Gongbo Zhou, Jiangsu (CN); Yu Tang, Jiangsu (CN); Fan Jiang, Jiangsu (CN); Yuxing Peng, Jiangsu (CN); Gang Shen, Jiangsu (CN); Hao Lu, Jiangsu (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 17/044,841

(22) PCT Filed: Sep. 12, 2019

(86) PCT No.: PCT/CN2019/105545
§ 371 (c)(1),
(2) Date: Oct. 1, 2020

(87) PCT Pub. No.: WO2020/119197
PCT Pub. Date: Jun. 18, 2020

(65) Prior Publication Data

US 2021/0053805 A1 Feb. 25, 2021

(30) Foreign Application Priority Data

Dec. 13, 2018 (CN) ..... 201811525361.2

(51) Int. Cl.
*E21B 19/00* (2006.01)
*B66D 1/52* (2006.01)

(52) U.S. Cl.
CPC ..... *B66D 1/52* (2013.01); *E21B 19/008* (2013.01)

(58) Field of Classification Search
CPC ..... E21B 19/008; B66D 1/26; B66D 1/36; B66D 1/38; B66D 1/52
See application file for complete search history.

(56) References Cited

FOREIGN PATENT DOCUMENTS

CN 203998524 A 12/2014
CN 104590974 A 5/2015
(Continued)

OTHER PUBLICATIONS

International search report of PCT/CN2019/105545.
Written opinion of PCT/CN2019/105545.
The first office action of CN 2018115253612.

*Primary Examiner* — Sang K Kim
*Assistant Examiner* — Nathaniel L Adams
(74) *Attorney, Agent, or Firm* — Dragon Sun Law Firm, PC; Jinggao Li, Esq.

(57) ABSTRACT

A tension balance system for steel wire ropes on a friction hoisting driving end of an ultra-deep well includes a friction wheel, left and right guiding wheels, left and right steel wire ropes, left and right adjustment wheels, left and right rewinding wheels, left and right adjustment oil cylinders, a hydraulic pipeline, a pump station, a pipeline switch group, left and right hoisting containers, balance ropes, and reels. The friction wheel is disposed in the middle, the left and right adjustment wheels and the left and right rewinding wheels are circularly distributed around the friction wheel, the left and right guiding wheels, the left and right adjustment wheels, and left and right rewinding wheels are all symmetrically disposed on two sides of the friction wheel; both a quantity of left steel wire ropes and a quantity of right steel wire ropes are even numbers more than 2.

13 Claims, 4 Drawing Sheets

(56) References Cited

FOREIGN PATENT DOCUMENTS

| | | | |
|---|---|---|---|
| CN | 106865384 | A | 6/2017 |
| CN | 108584617 | A | 9/2018 |
| CN | 109502454 | A | 3/2019 |
| KR | 20070075967 | A | 7/2007 |
| SU | 1533977 | A | 1/1990 |

TENSION BALANCE SYSTEM AND METHOD FOR STEEL WIRE ROPES ON FRICTION HOISTING DRIVING END OF ULTRA-DEEP WELL

CROSS-REFERENCE TO RELATED APPLICATIONS

This application is a national stage application of PCT Application No. PCT/CN2019/105545. This Application claims priorities from PCT Application No. PCT/CN2019/105545, filed Sep. 12, 2019, and CN Application No. CN 2018115253612, filed Dec. 13, 2018, the contents of which are incorporated herein in the entirety by reference.

FIELD OF THE INVENTION

The present invention relates to a multi-rope friction hoisting system in an ultra-deep well, and in particular, to a tension balance system and method for steel wire ropes on a friction hoisting driving end of an ultra-deep well.

DESCRIPTION OF RELATED ART

During multi-rope friction hoisting in an ultra-deep well, due to errors of steel wire ropes in a manufacturing and installation process and unbalanced loading in a hoisting process, tension of the steel wire ropes is usually unbalanced, and wear degrees of the steel wire ropes are different, thereby directly affecting service lives of the steel wire ropes.

There are a large quantity of steel wire ropes for friction hoisting, lengths and widths of hoisting containers are affected by a cross section of a wellbore, and a distance between the hoisting containers is limited. As a result, a distance between rope grooves is relatively short. Consequently, a distance between side-by-side head sheaves is extremely short in a current conventional friction hoisting manner, and cannot be effectively adjusted.

To resolve a problem of tension imbalance of steel wire ropes, in most current tension balance systems for steel wire ropes, a container tension balance apparatus is used for adjusting tension of steel wire ropes. The apparatus is disposed on a hoisting load end, and has a relatively great self-weight, thereby affecting hoisting and mechanical efficiency; in addition, an adjustment range of a hydraulic tension balance apparatus connected to a container is relatively small, and lengths of ropes need to be adjusted each time adjustment limit positions are reached. Workload for performing maintenance through frequent rope adjustment is great, and working efficiency of a hoisting system is also affected.

SUMMARY OF THE INVENTION

Technical Problem

To overcome the foregoing disadvantages in the prior art, the present invention provides a tension balance system and method for steel wire ropes on a friction hoisting driving end of an ultra-deep well, which can effectively improve hoisting and mechanical efficiency and substantially adjust tension balance of the steel wire ropes; and can improve hoisting efficiency of a hoisting system without performing maintenance by frequently and manually adjusting the ropes.

Technical Solution

To resolve the technical problem, a technical solution used in the present invention is to provide a tension balance system for steel wire ropes on a friction hoisting driving end of an ultra-deep well, including a friction wheel, a left guiding wheel, a right guiding wheel, left steel wire ropes, right steel wire ropes, left adjustment wheels, right adjustment wheels, a left rewinding wheel, a right rewinding wheel, left adjustment oil cylinders, right adjustment oil cylinders, a hydraulic pipeline, a pump station, a pipeline switch group, upper limiting switches, lower limiting switches, a left hoisting container, a right hoisting container, balance ropes, and reels. The friction wheel is disposed in the middle, the left adjustment wheels, the left rewinding wheel, the right adjustment wheels, and the right rewinding wheel are circularly distributed around the friction wheel, the left guiding wheel and the right guiding wheel are horizontally aligned and respectively symmetrically disposed on lower left and lower right of the friction wheel, and a horizontal distance between a vertical tangent on which a right wheel rim of the left guiding wheel is located and a vertical tangent on which a left wheel rim of the right guiding wheel is located is a horizontal distance between the left hoisting container and the right hoisting container; the left adjustment wheels and the right adjustment wheels are horizontally aligned and respectively symmetrically disposed on upper left and upper right of the friction wheel, the left rewinding wheel is disposed between the left adjustment wheels and the left guiding wheel, the right rewinding wheel is disposed between the right adjustment wheels and the right guiding wheel, and the left rewinding wheel and the right rewinding wheel are horizontally aligned and respectively symmetrically disposed on lower left and lower right of the friction wheel; a quantity of the left steel wire ropes and a quantity of the right steel wire ropes are the same and both are even numbers more than 2; one end of each of the left steel wire ropes is connected to the right hoisting container, and the other end passes around the right guiding wheel, the friction wheel, the left rewinding wheel, the friction wheel, the left adjustment wheel, and the left guiding wheel in sequence, and then is connected to the left hoisting container; one end of each of the right steel wire ropes is connected to the right hoisting container, and the other end passes around the right guiding wheel, the right adjustment wheel, the friction wheel, the right rewinding wheel, the friction wheel, and the left guiding wheel in sequence, and then is connected to the left hoisting container; tops of the left hoisting container and the right hoisting container are each fixedly provided with two reels; a left end and a right end of a steel wire rope corresponding to each of the adjustment wheels are connected to the left hoisting container and the right hoisting container by using the reels, and the reels are each connected to two steel wire ropes; lower ends of the left hoisting container and the right hoisting container are connected through the balance ropes; and both a quantity of the adjustment wheels and a quantity of the adjustment oil cylinders are the same as that of the steel wire ropes, both the left adjustment wheels and the right adjustment wheels have a degree of freedom of movement in a radial direction of the friction wheel, the left adjustment wheels are connected to the left adjustment oil cylinders to perform radial driving, the right adjustment wheels are connected to the right adjustment oil cylinders to perform radial driving, both the left adjustment oil cylinders and the right adjustment oil cylinders travel in the radial direction of the friction wheel, the adjustment oil cylinders are connected to the pump station through the hydraulic pipeline, and the hydraulic pipeline is provided with the pipeline switch group; and an outer side and an inner side of each of the left adjustment wheels and the right adjustment wheels in the radial direction of the friction wheel are respectively provided with an upper limiting switch and a lower limiting switch.

Advantageous Effect

Compared with the prior art, a tension balance system and method for steel wire ropes on a friction hoisting driving end of an ultra-deep well of the present invention are set on a driving end, so that hoisting load is not increased and mechanical efficiency can be effectively improved; when tension balance of steel wire ropes on a single side is adjusted, a method for implementing communication through a hydraulic pipeline is first used for adjustment, and then independent adjustment is performed for a problem of a relatively great length difference between the steel wire ropes on the single side that may occur after the adjustment, so that the tension balance system may be maintained to effectively work in a long term; further, substantial tension balance adjustment on the steel wire ropes can be powerfully adaptively performed, and hoisting efficiency of a hoisting system is improved without performing maintenance by frequently and manually adjusting the ropes.

BRIEF DESCRIPTION OF THE DRAWINGS

The present invention is further described below with reference to the accompanying drawings and embodiments.

Figure 1:
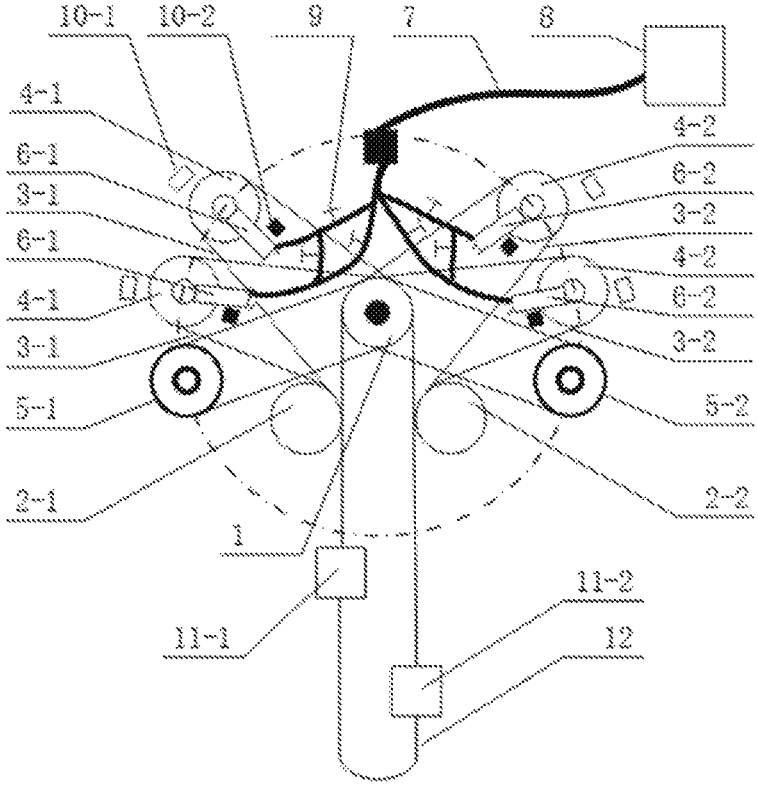
FIG. 1 is a schematic structural diagram of an embodiment in which there are two left steel wire ropes and two right steel wire ropes according to the present invention.

In the drawings: 1. Friction wheel, 2-1. Left guiding wheel, 2-2. Right guiding wheel, 3-1. Left steel wire rope, 3-2. Right steel wire rope, 4-1. Left adjustment wheel, 4-2. Right adjustment wheel, 5-1. Left rewinding wheel, 5-2. Right rewinding wheel, 6-1. Left adjustment oil cylinder, 6-2. Right adjustment oil cylinder, 7. Hydraulic pipeline, 7-1-1. Left hydraulic pipeline, 7-1-2. Left middle hydraulic pipeline, 7-2-1. Right hydraulic pipeline, 7-2-2. Right middle hydraulic pipeline, 7-3. Hydraulic main line, 8. Pump station, 9. Pipeline switch group, 9-1-1. Left pipeline switch, 9-1-2. Left middle pipeline switch, 9-2-1. Right pipeline switch, 9-2-2. Right middle pipeline switch, 10-1. Upper limiting switch, 10-2. Lower limiting switch, 11-1. Left hoisting container, 11-2. Right hoisting container, 12. Balance rope, 13. Reel, 14. Steel wire rope buckle.

DETAILED DESCRIPTION OF THE INVENTION

In order to make the objectives, technical solutions, and advantages of the present invention more comprehensible, the technical solutions according to embodiments of the present invention are clearly and completely described in the following with reference to the accompanying drawings of the embodiments of the present invention. Apparently, the embodiments in the following description are merely some rather than all of the embodiments of the present invention. All other embodiments obtained by persons of ordinary skill in the art based on the embodiments of the present invention without creative efforts shall fall within the protection scope of the present invention.

As shown in FIG. 1, a tension balance system for steel wire ropes on a friction hoisting driving end of an ultra-deep well in an exemplary embodiment of the present invention mainly includes one friction wheel 1, one left guiding wheel 2-1, one right guiding wheel 2-2, two left steel wire ropes 3-1, two right steel wire ropes 3-2, two left adjustment wheels 4-1, two right adjustment wheels 4-2, one left rewinding wheel 5-1, one right rewinding wheel 5-2, two left adjustment oil cylinders 6-1, two right adjustment oil cylinders 6-2, one hydraulic pipeline 7, one pump station 8, one pipeline switch group 9, four upper limiting switches 10-1, four lower limiting switches 10-2, one left hoisting container 11-1, one right hoisting container 11-2, four balance ropes 12, two reels 13, and four steel wire rope buckles 14. The friction wheel 1 is disposed in the middle, the left adjustment wheels 4-1, the left rewinding wheel 5-1, the right adjustment wheels 4-2, and the right rewinding wheel 5-2 are circularly distributed around the friction wheel 1, the left guiding wheel 2-1 and the right guiding wheel 2-2 are horizontally aligned and respectively symmetrically disposed on lower left and lower right of the friction wheel 1, a horizontal distance between a vertical tangent on which a right wheel rim of the left guiding wheel 2-1 is located and a vertical tangent on which a left wheel rim of the right guiding wheel 2-2 is located is a horizontal distance between the left hoisting container 11-1 and the right hoisting container 11-2, and lower ends of the left hoisting container 11-1 and the right hoisting container 11-2 are connected through the balance ropes 12. The left steel wire ropes 3-1 and the right steel wire ropes 3-2 are wound between the guiding wheels, the friction wheel 1, the rewinding wheels, and the adjustment wheels, both the left adjustment wheels 4-1 and the right adjustment wheels 4-2 have a degree of freedom of movement in a radial direction of the friction wheel 1, the left adjustment oil cylinders 6-1 and the right adjustment oil cylinders 6-2 travel in the radial direction of the friction wheel 1, the left adjustment oil cylinders 6-1 are connected to the left adjustment wheels 4-1 to perform radial driving, and the right adjustment oil cylinders 6-2 are connected to the right adjustment wheels 4-2 to perform radial driving, the adjustment oil cylinders are connected to the pump station 8 through the hydraulic pipeline 7, and the hydraulic pipeline 7 is provided with the pipeline switch group 9; and an outer side and an inner side of each of the left adjustment wheels 4-1 and the right adjustment wheels 4-2 in the radial direction of the friction wheel 1 are respectively provided with an upper limiting switch 10-1 and a lower limiting switch 10-2.

Figure 2:
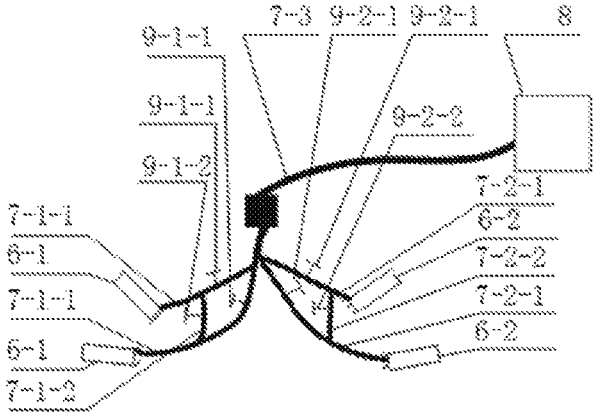
FIG. 2 is a schematic structural diagram of a hydraulic pipeline in the embodiment in FIG. 1.

As shown in FIG. 2, the hydraulic pipeline 7 includes two left hydraulic pipelines 7-1-1, one left middle hydraulic pipeline 7-1-2, two right hydraulic pipelines 7-2-1, one right middle hydraulic pipeline 7-2-2, and one hydraulic main line 7-3, and the pipeline switch group 9 includes two left pipeline switches 9-1-1, one left middle pipeline switch 9-1-2, two right pipeline switches 9-2-1, and one right middle pipeline switch 9; ends of the left hydraulic pipelines 7-1-1 are respectively connected to the left adjustment oil cylinders 6-1, ends of the right hydraulic pipelines 7-2-1 are respectively connected to the right adjustment oil cylinders 6-2, the other ends are jointly connected to a same end of the hydraulic main line 7-3, and the other end of the hydraulic main line 7-3 is connected to the pump station 8; the left hydraulic pipelines 7-1-1 are provided with the left pipeline switches 9-1-1, the left middle hydraulic pipeline 7-1-2 is disposed between the two left hydraulic pipelines 7-1-1, one end of the left middle hydraulic pipeline 7-1-2 is disposed between one left adjustment oil cylinder 6-1 and one left pipeline switch 9-1-1, the other end is disposed between the other left adjustment oil cylinder 6-1 and the other left pipeline switch 9-1-1, and the left middle hydraulic pipeline 7-1-2 is provided with the left middle pipeline switch 9-1-2; and the right hydraulic pipelines 7-2-1 are provided with the right pipeline switches 9-2-1, the right middle hydraulic pipeline 7-2-2 is disposed between the two right hydraulic pipelines 7-2-1, one end of the right middle hydraulic pipeline 7-2-2 is disposed between one right adjustment oil cylinder 6-2 and one right pipeline switch 9-2-1, the other end is disposed between the other right adjustment oil cylinder 6-2 and the other right pipeline switch 9-2-1, and the right middle hydraulic pipeline 7-2-2 is provided with the right middle pipeline switch 9-2-2.

For a tension balance method for steel wire ropes on a friction hoisting driving end of an ultra-deep well of the present invention, reference is made to FIG. 1 and FIG. 2, and a process is as follows:

In an initial state, the left pipeline switches 9-1-1 are turned off, and the left middle pipeline switch 9-1-2 is turned on, where both the two left adjustment wheels 4-1 are located on middle positions between corresponding upper limiting switches 10-1 and corresponding lower limiting switches 10-2.

When tension of the two left steel wire ropes 3-1 is unbalanced, the two left adjustment wheels 4-1 generate different pressures on the left adjustment oil cylinders 6-1 connected to the left adjustment wheels 4-1, the two adjustment oil cylinders are in communication through the left hydraulic pipelines 7-1-1 and the left middle hydraulic pipeline 7-1-2, an adjustment oil cylinder corresponding to a steel wire rope of the two left steel wire ropes 3-1 that has larger tension has a traveling distance contracted, and a corresponding left adjustment wheel 4-1 will be close to the friction wheel 1 in the radial direction of the friction wheel 1, so that the steel wire rope is slacker than before, and the tension is reduced; an adjustment oil cylinder corresponding to a steel wire rope of the left steel wire ropes 3-1 that has smaller tension has a traveling distance extended, and a corresponding left adjustment wheel 4-1 is far away from the friction wheel 1 in the radial direction of the friction wheel 1, so that the steel wire rope is tauter than before, and the tension is increased; and when the two left steel wire ropes 3-1 have the same tension, the two left adjustment oil cylinders 6-1 no longer act, and the two left adjustment wheels 4-1 no longer move.

In the foregoing adjustment process, if one of the left adjustment wheels 4-1 exceeds a value set by an upper limiting switch 10-1 corresponding to the left adjustment wheel 4-1, the upper limiting switch 10-1 acts, the left middle pipeline switch 9-1-2 is turned off, a left pipeline switch 9-1-1 corresponding to the left adjustment wheel 4-1 is turned on, and the pump station 8 acts, to reduce a hydraulic oil pressure of the left adjustment oil cylinder 6-1, so that the left adjustment wheel 4-1 goes back to the middle position between the upper limiting switch 10-1 and the lower limiting switch 10-2; when the left adjustment wheel 4-1 goes back to the middle position between the upper limiting switch 10-1 and the lower limiting switch, the left pipeline switch 9-1-1 and the left middle pipeline switch 9-1-2 go back to the on-off states of the switches in the initial state; and if one of the left adjustment wheels 4-1 exceeds a value set by a lower limiting switch 10-2 corresponding to the left adjustment wheel 4-1, the lower limiting switch 10-2 acts, the left middle pipeline switch 9-1-2 is turned off, a left pipeline switch 9-1-1 corresponding to the left adjustment wheel 4-1 is turned on, and the pump station 8 acts, to increase a hydraulic oil pressure of the left adjustment oil cylinder 6-1, so that the left adjustment wheel 4-1 goes back to the middle position between the upper limiting switch 10-1 and the lower limiting switch 10-2; when the left adjustment wheel 4-1 goes back to the middle position between the upper limiting switch 10-1 and the lower limiting switch 10-2, the left pipeline switch 9-1-1 and the left middle pipeline switch 9-1-2 go back to the on-off states of the switches in the initial state. This is a method for adjusting tension balance of the left steel wire ropes 3-1.

A method for adjusting tension balance of the right steel wire ropes 3-2 is the same as the above. Details are not described herein again.

Figure 3:
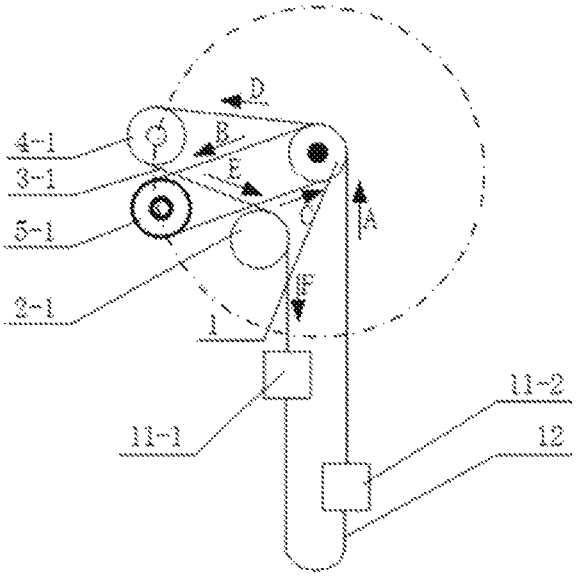
FIG. 3 is a schematic diagram of rope winding of a left steel wire rope located in a relatively lower position in the embodiment in FIG. 1.
Figure 4:
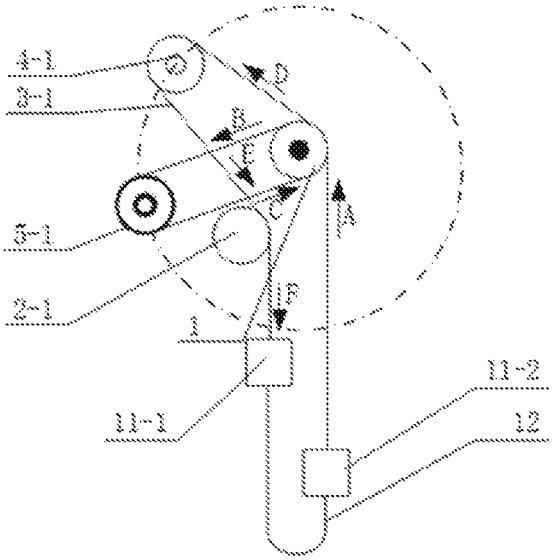
FIG. 4 is a schematic diagram of rope winding of a left steel wire rope located in a relatively upper position in the embodiment in FIG. 1.

As shown in FIG. 3 and FIG. 4, two left steel wire ropes 3-1 are wound according to an alphabetical order shown in the figures: one end of a left steel wire rope 3-1 is connected to the right hoisting container 11-2, and the other end passes around the right guiding wheel 2-2, the friction wheel 1, the left rewinding wheel 5-1, the friction wheel 1, the left adjustment wheel 4-1, and the left guiding wheel 2-1 in sequence, and then is connected to the left hoisting container 11-1, to construct single-rope friction hoisting in a multi-rope friction hoisting system. Moreover, when the right hoisting container 11-2 is hoisted, the left steel wire ropes 3-1 move in the alphabetical order shown in the figures.

Figure 5:
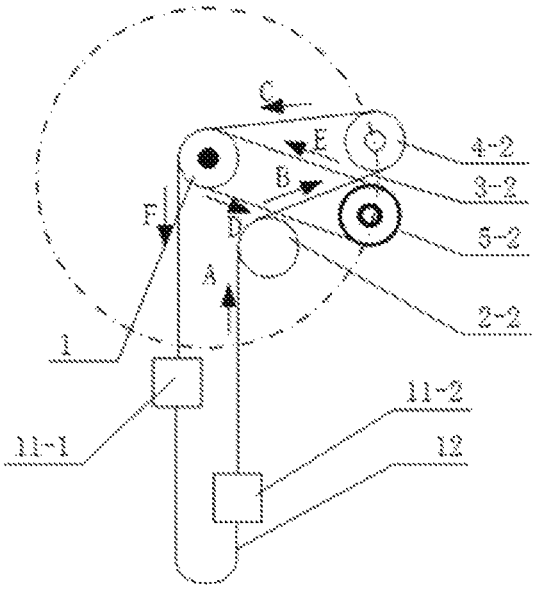
FIG. 5 is a schematic diagram of rope winding of a right steel wire rope located in a relatively lower position in the embodiment in FIG. 1.
Figure 6:
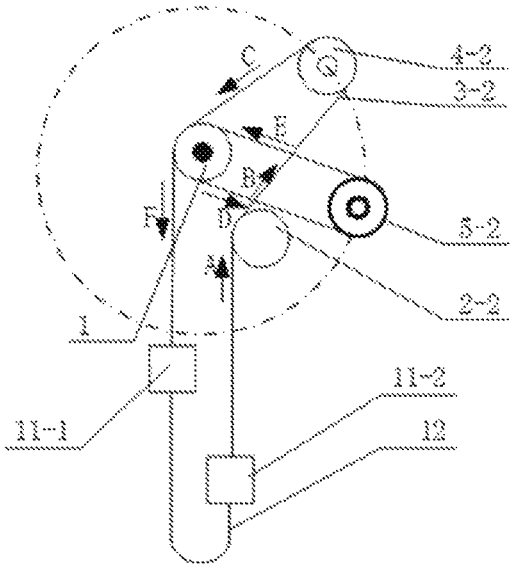
FIG. 6 is a schematic diagram of reel deployment on a right hoisting container in the embodiment in FIG. 1.

As shown in FIG. 5 and FIG. 6, right steel wire ropes 3-2 are wound according to an alphabetical order shown in the figures: one end of a right steel wire rope 3-2 is connected to the right hoisting container 11-2, and the other end passes around the right guiding wheel 2-2, the right adjustment wheel 4-2, the friction wheel 1, the right rewinding wheel 5-2, the friction wheel 1, and the left guiding wheel 2-1 in sequence, and then is connected to the left hoisting container 11-1, to construct single-rope friction hoisting in a multi-rope friction hoisting system. Moreover, when the right hoisting container 11-2 is hoisted, the right steel wire ropes 3-2 move in the alphabetical order shown in the figures.

Figure 7:
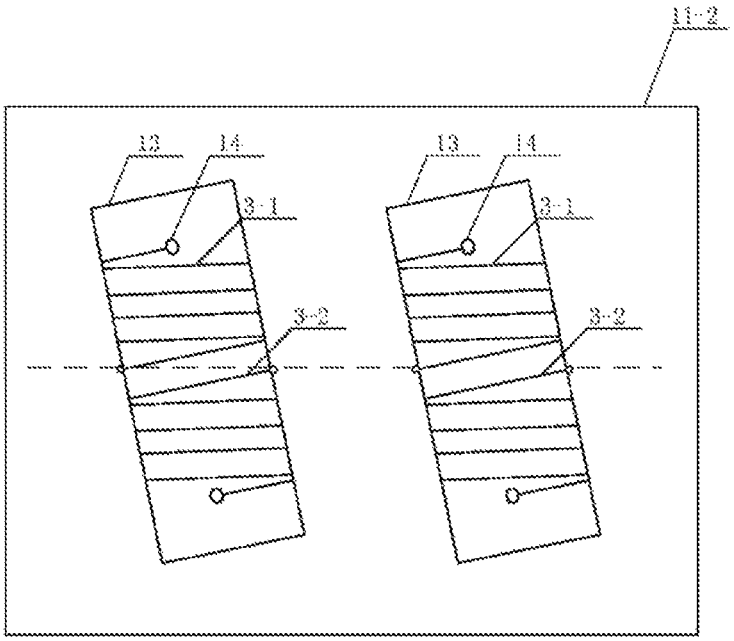
FIG. 7 is a schematic diagram of winding of two steel wire ropes around a reel in this embodiment of the present invention.

As shown in FIG. 7, reel deployment on the right hoisting container 11-2 is used as an example. On the right hoisting container 11-2, two reels 13 are fastened on a top of the right hoisting container 11-2 by using bearing supports, one of the reels 13 is connected to one left steel wire rope 3-1 and one right steel wire rope 3-2 that are located on relatively low positions, and the other reel 13 is connected to one left steel wire rope 3-1 and one right steel wire rope 3-2 that are located on relatively high positions; and one end of each of two steel wire ropes connected to each of the reels 13 is connected to the reel 13 on a position that is on an external cylindrical side surface of the reel 13 and close to an end face by using a steel wire rope buckle 14; spiral winding directions of the two steel wire ropes on the reel 13 are the same; and rope outlet ends of the two steel wire ropes are distributed on two sides of a middle portion of a shaft of the reel, and both the ropes get out from a lower side of the reel 13; and total four rope outlet ends of the two reels 13 are located inside a vertical plane parallel to an axis of the right guiding wheel 2-2.

Referring to FIG. 7, the reel 13 connected to a left steel wire rope 3-1 and a right steel wire rope 3-2 that are located on relatively low positions is used as an example. The two steel wire ropes respectively exert a torque causing the reel 13 to have a rotation tendency on the reel 13. When tension that is of the two steel wire ropes that close to a reel end is different, the two torques are different. The reel 13 rotates from an upper side to a side of one of the two steel wire ropes that has smaller tension, a steel wire rope that has larger tension is slacken off from the reel 13, and the steel wire rope that has smaller tension is wound tightly around the reel 13 until tension of the two steel wire ropes close to a reel end is the same, and the reel 13 no longer rotates, so as to complete tension balance adjustment of the two steel wire ropes on a right hoisting container end. The other reel 13 completes, on the right hoisting container end, tension balance adjustment of a left steel wire rope 3-1 and a right steel wire rope 3-2 that are located on relatively high positions.

Tension balance adjustment of steel wire ropes on different sides on the left hoisting container 11-1 that is close to a left hoisting container end and completed by using the reel 13 is similar to the foregoing adjustment process. Details are not described herein again.

By combining the foregoing tension balance adjustment of the two left steel wire ropes 3-1 and the foregoing tension balance adjustment of the two right steel wire ropes 3-2 that are completed by using a hydraulic element, tension balance adjustment of the two left steel wire ropes 3-1 and the two right steel wire ropes 3-2 on each of the left hoisting container end and the right hoisting container end in this embodiment may be completed.

A quantity of steel wire ropes that may be adjusted in the present invention is not limited to 4 in this embodiment, and may alternatively be 6, 8, or another even number more than 2.

Beneficial effects of the present invention are:

1) The tension balance system is disposed on a driving end, so that additional load generated by adding a tension balance apparatus on a current hoisting container is not increased, and mechanical efficiency can be effectively improved.

2) When tension balance of steel wire ropes on a single side is adjusted, a method for implementing communication through the hydraulic pipeline 7 is first used for adjustment, and then independent adjustment is performed for a problem of a relatively great length difference between the steel wire ropes on the single side that may occur after the adjustment, so that the tension balance system may be maintained to effectively work in a long term.

3) Further, substantial tension balance adjustment on the steel wire ropes can be powerfully adaptively performed, and hoisting efficiency of a hoisting system is improved without performing maintenance by frequently and manually adjusting the ropes.

The foregoing descriptions are merely exemplary embodiments of the present invention, and are not intended to limit the present invention in any form. Any simple modifications and equivalent changes that are made on the foregoing embodiments according to the technical essence of the present invention shall fall within the protection scope of the present invention.

What is claimed is:

1. A tension balance system for steel wire ropes on a friction hoisting driving end of a well, comprising:

a friction wheel (1);

a left guiding wheel (2-1);

a right guiding wheel (2-2);

left steel wire ropes (3-1);

right steel wire ropes (3-2);

left adjustment wheels (4-1);

right adjustment wheels (4-2);

a left rewinding wheel (5-1);

a right rewinding wheel (5-2);

left adjustment oil cylinders (6-1);

right adjustment oil cylinders (6-2);

a hydraulic pipeline (7);

a pump station (8);

a pipeline switch group (9);

upper limiting switches;

lower limiting switches (10-2);

a left hoisting container (11-1);

a right hoisting container (11-2), balance ropes (12); and reels (13), wherein the friction wheel (1) is disposed in the middle;

the left adjustment wheels (4-1), the left rewinding wheel (5-1), the right adjustment wheels (4-2), and the right rewinding wheel (5-2) are circularly distributed around the friction wheel (1);

the left guiding wheel (2-1) and the right guiding wheel (2-2) are horizontally aligned and respectively symmetrically disposed on lower left and lower right of the friction wheel (1); and a horizontal distance between a vertical tangent on which a right wheel rim of the left guiding wheel (2-1) is located and a vertical tangent on which a left wheel rim of the right guiding wheel (2-2) is located is a horizontal distance between the left hoisting container (11-1) and the right hoisting container (11-2);

the left adjustment wheels (4-1) and the right adjustment wheels (4-2) are horizontally aligned and respectively symmetrically disposed on upper left and upper right of the friction wheel (1); the left rewinding wheel (5-1) is disposed between the left adjustment wheels (4-1) and the left guiding wheel (2-1), the right rewinding wheel (5-2) is disposed between the right adjustment wheels (4-2) and the right guiding wheel (2-2); and the left rewinding wheel (5-1) and the right rewinding wheel (5-2) are horizontally aligned and respectively symmetrically disposed on lower left and lower right of the friction wheel (1);

a quantity of the left steel wire ropes (3-1) and a quantity of the right steel wire ropes (3-2) are the same and both are even numbers more than 2; one end of each of the left steel wire ropes (3-1) is connected to the right hoisting container (11-2); and the other end passes around the right guiding wheel (2-2), the friction wheel (1), the left rewinding wheel (5-1), the friction wheel (1), the left adjustment wheel (4-1), and the left guiding wheel (2-1) in sequence; and then is connected to the left hoisting container (11-1); one end of each of the right steel wire ropes (3-2) is connected to the right hoisting container (11-2); and the other end passes around the right guiding wheel (2-2), the right adjustment wheel (4-2), the friction wheel (1), the right rewinding wheel (5-2), the friction wheel (1), and the left guiding wheel (2-1) in sequence, and then is connected to the left hoisting container (11-1);

tops of the left hoisting container (11-1) and the right hoisting container (11-2) are each fixedly provided with two reels (13); a left end and a right end of a steel wire rope corresponding to each of the adjustment wheels are connected to the left hoisting container (11-1) and the right hoisting container (11-2) by using the reels (13), and the reels (13) are each connected to two steel wire ropes; and both a quantity of the adjustment wheels and a quantity of the adjustment oil cylinders are the same as that of the steel wire ropes; both the left adjustment wheels (4-1) and the right adjustment wheels (4-2) have a degree of freedom of movement in a radial direction of the friction wheel (1); the left adjustment wheels (4-1) are connected to the left adjustment oil cylinders (6-1) to perform radial driving, the right adjustment wheels (4-2) are connected to the right adjustment oil cylinders (6-2) to perform radial driving; both the left adjustment oil cylinders (6-1) and the right adjustment oil cylinders (6-2) travel in the radial direction of the friction wheel (1), the adjustment oil cylinders are connected to the pump station (8) through the hydraulic pipeline (7); and the hydraulic pipeline (7) is provided with the pipeline switch group (9); and an outer side and an inner side of each of the left adjustment wheels (4-1) and the right adjustment wheels (4-2) in the radial direction of the friction wheel (1) are respectively provided with an upper limiting switch (10-1) and a lower limiting switch (10-2).

2. The tension balance system for the steel wire ropes on the friction hoisting driving end of the ultra-deep well according to claim 1, wherein the hydraulic pipeline (7) comprises a plurality of left hydraulic pipelines (7-1-1), a plurality of right hydraulic pipelines (7-2-1), and one hydraulic main line (7-3), and the pipeline switch group (9) comprises a plurality of left pipeline switches (9-1-1) and a plurality of right pipeline switches (9); ends of the left hydraulic pipelines (7-1-1) are respectively connected to the left adjustment oil cylinders (6-1); ends of the right hydraulic pipelines (7-2-1) are respectively connected to the right adjustment oil cylinders (6-2); all the other ends thereof are connected to a same end of the hydraulic main line (7-3); and the other end of the hydraulic main line (7-3) is connected to the pump station (8); the left hydraulic pipelines (7-1-1) are each provided with one left pipeline switch (9-1-1); the left hydraulic pipelines (7-1-1) are connected with each other through one left middle hydraulic pipeline (7-1-2); two ends of the left middle hydraulic pipeline (7-1-2) are respectively disposed between the left adjustment oil cylinders (6-1) and the left pipeline switches (9-1-1) on two sides; and the left middle hydraulic pipeline (7-1-2) is provided with a left middle pipeline switch (9-1-2); and the right hydraulic pipelines (7-2-1) are each provided with one right pipeline switch (9-2-1), the right hydraulic pipelines (7-2-1) are connected with each other through one right middle hydraulic pipeline (7-2-2); two ends of the right middle hydraulic pipeline (7-2-2) are respectively disposed between the right adjustment oil cylinders (6-2) and the right pipeline switches (9-2-1) on the two sides; and the right middle hydraulic pipeline (7-2-2) is provided with a right middle pipeline switch (9-2-2).

3. The tension balance system for the steel wire ropes on the friction hoisting driving end of the ultra-deep well according to claim 2, wherein a left end of a steel wire rope corresponding to one adjustment wheel on a left side and a left end of a steel wire rope corresponding to one adjustment wheel on a right side are connected to the left hoisting container (11-1) by being connected to a same reel (13) on the left hoisting container (11-1); a right end of a steel wire rope corresponding to one adjustment wheel on the left side and a right end of a steel wire rope corresponding to one adjustment wheel on the right side are connected to the right hoisting container (11-2) by being connected to a same reel (13) on the right hoisting container (11-2).

4. The tension balance system for the steel wire ropes on the friction hoisting driving end of the ultra-deep well according to claim 3, wherein one end of each of the steel wire ropes is connected to the reel (13) on a position that is on an external cylindrical side surface of the reel (13) and close to an end surface by using a steel wire rope buckle (14); spiral winding directions of two steel wire ropes on the reel (13) are the same; and rope outlet ends of the two steel wire ropes are distributed on two sides of a middle portion of a shaft of the reel (13), and both the ropes get out from a lower side of the reel (13).

5. The tension balance system for the steel wire ropes on the friction hoisting driving end of the ultra-deep well according to claim 1, wherein a left end of a steel wire rope corresponding to one adjustment wheel on a left side and a left end of a steel wire rope corresponding to one adjustment wheel on a right side are connected to the left hoisting container (11-1) by being connected to a same reel (13) on the left hoisting container (11-1); a right end of a steel wire rope corresponding to one adjustment wheel on the left side and a right end of a steel wire rope corresponding to one adjustment wheel on the right side are connected to the right hoisting container (11-2) by being connected to a same reel (13) on the right hoisting container (11-2).

6. The tension balance system for the steel wire ropes on the friction hoisting driving end of the ultra-deep well according to claim 5, wherein one end of each of the steel wire ropes is connected to the reel (13) on a position that is on an external cylindrical side surface of the reel (13) and close to an end surface by using a steel wire rope buckle (14); spiral winding directions of two steel wire ropes on the reel (13) are the same; and rope outlet ends of the two steel wire ropes are distributed on two sides of a middle portion of a shaft of the reel (13), and both the ropes get out from a lower side of the reel (13).

7. The tension balance system for the steel wire ropes on the friction hoisting driving end of the ultra-deep well according to claim 6, wherein the reels (13) are fastened on tops of the hoisting containers by using a bearing support; and on each of the hoisting containers, total four rope outlet ends of the two reels (13) are located inside a vertical plane parallel to an axis of a guiding wheel on a same side as the hoisting container.

8. The tension balance system for the steel wire ropes on the friction hoisting driving end of the ultra-deep well according to claim 1, wherein the reels (13) are fastened on tops of the hoisting containers by using a bearing support; and on each of the hoisting containers, total four rope outlet ends of the two reels (13) are located inside a vertical plane parallel to an axis of a guiding wheel on a same side as the hoisting container.

9. A tension balance method for steel wire ropes completed based on the tension balance system for the steel wire ropes on the friction hoisting driving end of the ultra-deep well according to claim 1, comprising the following steps:

in an initial state, the left pipeline switches (9-1-1) are turned off; and left hydraulic pipelines (7-1-1) are turned on, wherein the left adjustment wheels (4-1) are all located on middle positions between corresponding upper limiting switches (10-1) and corresponding lower limiting switches (10-2);

when tension of the left steel wire ropes (3-1) is unbalanced; the left adjustment wheels (4-1) generate different pressures on the left adjustment oil cylinders (6-1) connected to the left adjustment wheels (4-1); the adjustment oil cylinders are in communication through the left hydraulic pipelines (7-1-1) and a left middle hydraulic pipeline (7-1-2), an adjustment oil cylinder corresponding to a steel wire rope of the left steel wire ropes (3-1) that has larger tension has a traveling distance contracted, and a corresponding left adjustment wheel (4-1) is close to the friction wheel (1) in a radial direction of the friction wheel (1), so that the steel wire rope is slacker than before, and the tension is reduced; an adjustment oil cylinder corresponding to a steel wire rope of the left steel wire ropes (3-1) that has smaller tension has a traveling distance extended, and a corresponding left adjustment wheel (4-1) is far away from the friction wheel (1) in the radial direction of the friction wheel (1), so that the steel wire rope is tauter than before, and the tension is increased; and when the left steel wire ropes (3-1) have the same tension, the left adjustment oil cylinders (6-1) no longer act, and the left adjustment wheels (4-1) no longer move;

in the foregoing adjustment process, if one left adjustment wheel (4-1) exceeds a value set by an upper limiting switch (10-1) corresponding to the left adjustment wheel (4-1), the upper limiting switch (10-1) acts; a left middle pipeline switch (9-1-2) is turned off; a left pipeline switch (9-1-1) corresponding to the left adjustment wheel (4-1) is turned on; and the pump station (8) acts, to reduce a hydraulic oil pressure of the left adjustment oil cylinder (6-1), so that the left adjustment wheel (4-1) goes back to the middle position between the upper limiting switch (10-1) and a lower limiting switch (10-2), and in this case, the left pipeline switch (9-1-1) and the left middle pipeline switch (9-1-2) go back to the on-off states of the switches in the initial state; and if one left adjustment wheel (4-1) exceeds a value set by the lower limiting switch (10-2) corresponding to the left adjustment wheel (4-1), the lower limiting switch (10-2) acts; the left middle pipeline switch (9-1-2) is turned off; a left pipeline switch (9-1-1) corresponding to the left adjustment wheel (4-1) is turned on; and the pump station (8) acts, to increase a hydraulic oil pressure of the left adjustment oil cylinder (6-1), so that the left adjustment wheel (4-1) goes back to the middle position between the upper limiting switch (10-1) and the lower limiting switch (10-2), and in this case, the left pipeline switch (9-1-1) and the left middle pipeline switch (9-1-2) go back to the on-off states of the switches in the initial state;

adjusting tension balance of the right steel wire rope (3-2) the same as the left steel wire rope (3-1); and two steel wire ropes connected to each of the reels (13) respectively exert a torque causing the reel (13) to have a rotation tendency; the reel (13) rotates from an upper side to a side of one of the two steel wire ropes that has smaller tension; a steel wire rope that has larger tension is slacken off from the reel (13), and the steel wire rope that has smaller tension is wound tightly around the reel (13) until tension of the two steel wire ropes close to a reel end is the same, and the reel (13) no longer rotates.

10. The tension balance method for steel wire ropes completed based on the tension balance system for the steel wire ropes on the friction hoisting driving end of the ultra-deep well according to claim 9, wherein the hydraulic pipeline (7) comprises a plurality of left hydraulic pipelines (7-1-1), a plurality of right hydraulic pipelines (7-2-1), and one hydraulic main line (7-3), and the pipeline switch group (9) comprises a plurality of left pipeline switches (9-1-1) and a plurality of right pipeline switches (9); ends of the left hydraulic pipelines (7-1-1) are respectively connected to the left adjustment oil cylinders (6-1); ends of the right hydraulic pipelines (7-2-1) are respectively connected to the right adjustment oil cylinders (6-2); all the other ends thereof are connected to a same end of the hydraulic main line (7-3); and the other end of the hydraulic main line (7-3) is connected to the pump station (8); the left hydraulic pipelines (7-1-1) are each provided with one left pipeline switch (9-1-1); the left hydraulic pipelines (7-1-1) are connected with each other through one left middle hydraulic pipeline (7-1-2); two ends of the left middle hydraulic pipeline (7-1-2) are respectively disposed between the left adjustment oil cylinders (6-1) and the left pipeline switches (9-1-1) on two sides; and the left middle hydraulic pipeline (7-1-2) is provided with a left middle pipeline switch (9-1-2); and the right hydraulic pipelines (7-2-1) are each provided with one right pipeline switch (9-2-1), the right hydraulic pipelines (7-2-1) are connected with each other through one right middle hydraulic pipeline (7-2-2); two ends of the right middle hydraulic pipeline (7-2-2) are respectively disposed between the right adjustment oil cylinders (6-2) and the right pipeline switches (9-2-1) on the two sides; and the right middle hydraulic pipeline (7-2-2) is provided with a right middle pipeline switch (9-2-2).

11. The tension balance method for steel wire ropes completed based on the tension balance system for the steel wire ropes on the friction hoisting driving end of the ultra-deep well according to claim 9, wherein a left end of a steel wire rope corresponding to one adjustment wheel on a left side and a left end of a steel wire rope corresponding to one adjustment wheel on a right side are connected to the left hoisting container (11-1) by being connected to a same reel (13) on the left hoisting container (11-1); a right end of a steel wire rope corresponding to one adjustment wheel on the left side and a right end of a steel wire rope corresponding to one adjustment wheel on the right side are connected to the right hoisting container (11-2) by being connected to a same reel (13) on the right hoisting container (11-2).

12. The tension balance system for the steel wire ropes on the friction hoisting driving end of the ultra-deep well according to claim 11, wherein one end of each of the steel wire ropes is connected to the reel (13) on a position that is on an external cylindrical side surface of the reel (13) and close to an end surface by using a steel wire rope buckle (14); spiral winding directions of two steel wire ropes on the reel (13) are the same; and rope outlet ends of the two steel wire ropes are distributed on two sides of a middle portion of a shaft of the reel (13), and both the ropes get out from a lower side of the reel (13).

13. The tension balance method for steel wire ropes completed based on the tension balance system for the steel wire ropes on the friction hoisting driving end of the ultra-deep well according to claim 9, wherein the reels (13) are fastened on tops of the hoisting containers by using a bearing support; and on each of the hoisting containers, total four rope outlet ends of the two reels (13) are located inside a vertical plane parallel to an axis of a guiding wheel on a same side as the hoisting container.

* * * * *